United States Patent [19]

Herbst et al.

[11] Patent Number: 5,071,080

[45] Date of Patent: Dec. 10, 1991

[54] DOCUMENT SHREDDING MACHINE

[75] Inventors: David E. Herbst, Bartlett; Charles D. Kimbro, Schaumburg, both of Ill.

[73] Assignee: Fellowes Manufacturing Company, Itasca, Ill.

[21] Appl. No.: 486,010

[22] Filed: Feb. 27, 1990

[51] Int. Cl.[5] ..... B02C 18/16

[52] U.S. Cl. ..... 241/166; 241/236; 241/285 R

[58] Field of Search ..... 241/166, 167, 236, 235, 241/100, 284 R, 285 A; 83/500, 664

[56] References Cited

U.S. PATENT DOCUMENTS

| | | |
|---|---|---|
| 1,019,828 | 3/1912 | O'Bryan . |
| 1,090,914 | 3/1914 | Guettler . |
| 1,178,386 | 4/1916 | Edwards . |
| 1,673,336 | 6/1928 | Lehmicke . |
| 1,699,157 | 1/1929 | Pendleton . |
| 1,731,967 | 10/1929 | Antonsen . |
| 2,182,219 | 12/1939 | Ashley . |
| 2,202,843 | 6/1940 | Edwards . |
| 2,216,612 | 10/1940 | Dimm et al. . |
| 2,224,948 | 12/1940 | Bloomquist . |
| 2,236,969 | 4/1941 | Flateboe . |
| 2,381,775 | 8/1945 | Roddy . |
| 2,554,114 | 5/1951 | Menkin et al. . |
| 2,770,302 | 11/1956 | Lee . |
| 2,873,923 | 2/1959 | Bergman . |
| 2,894,697 | 7/1959 | Panning et al. . |
| 3,033,064 | 5/1962 | Lee . |
| 3,126,931 | 3/1964 | Blanshine et al. . |
| 3,396,914 | 8/1968 | Liebman . |
| 3,510,077 | 5/1970 | Priscu . |
| 3,524,597 | 8/1970 | Burden, Jr. et al. . |
| 3,529,782 | 9/1970 | Liebman . |
| 3,620,461 | 11/1971 | Pelleschi et al. . |
| 3,620,462 | 11/1971 | Dooley, Jr. . |
| 3,630,460 | 12/1971 | Goldhammer . |
| 3,664,592 | 5/1972 | Schweigert et al. . |
| 3,724,766 | 4/1973 | Bosland . |
| 3,790,093 | 2/1974 | McIntyre . |
| 3,797,765 | 3/1974 | Samuels . |
| 3,860,180 | 1/1975 | Goldhammer . |
| 3,894,697 | 7/1975 | Lawson et al. . |
| 3,921,920 | 11/1975 | Brocard . |
| 3,931,935 | 1/1976 | Holman . |
| 3,960,334 | 6/1976 | Wudyka . |
| 4,018,392 | 4/1977 | Wagner . |
| 4,034,918 | 7/1977 | Culbertson et al. . |
| 4,068,805 | 1/1978 | Oswald . |
| 4,106,708 | 8/1978 | Kropa . |
| 4,172,400 | 10/1979 | Brierley . |
| 4,194,698 | 3/1980 | Kosmowski . |
| 4,200,239 | 4/1980 | Simone et al. . |
| 4,226,372 | 10/1980 | Wigand . |
| 4,257,565 | 3/1981 | Hatanaka . |
| 4,260,115 | 4/1981 | Hatanaka . |
| 4,330,092 | 5/1982 | Roman . |
| 4,334,650 | 6/1982 | Hardwick et al. . |
| 4,346,851 | 8/1982 | Bernardi et al. . |
| 4,349,159 | 9/1982 | Hardwick et al. . |
| 4,351,485 | 9/1982 | Hardwick et al. . |
| 4,355,766 | 10/1982 | Wigand . |
| 4,363,453 | 12/1982 | Hill et al. . |

(List continued on next page.)

FOREIGN PATENT DOCUMENTS

| | | | |
|---|---|---|---|
| 10681 | 5/1980 | European Pat. Off. | 241/236 |
| 3001507 | 7/1981 | Fed. Rep. of Germany | 83/500 |
| 705066 | 3/1954 | United Kingdom . | |
| 1502076 | 2/1978 | United Kingdom . | |
| 1569375 | 6/1980 | United Kingdom | 241/236 |

*Primary Examiner*—Mark Rosenbaum

*Attorney, Agent, or Firm*—Willian, Brinks, Olds, Hofer, Gilson & Lione

[57] ABSTRACT

A shredding mechanism having a continuous stripper to strip shredded material from the cutting surface of the shredding mechanism and having a bearing support for rotatably carrying the shafts of cutting cylinders. The stripper consists of upper teeth integrally formed on the inside surface of a top housing and bottom teeth integrally formed on the inside of a bottom base. The bearing support comprising two bearing plates integrally formed onto the inside surface of the bottom base. The bearing plates have semicircular indentations to rotatably carry the shafts of cutting cylinders.

20 Claims, 3 Drawing Sheets

(List continued on next page.)

4,385,732 5/1983 Williams .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,717,085 1/1988 Crane .
4,860,963 8/1989 Goldhammer et al. .
4,881,692 11/1989 Goldhammer et al. .
4,889,291 12/1989 Goldhammer et al. .

100
104
4
3
4
3
106

216
226
102
218
224
212
210
222
228
200
202
220
214
238
240
230
232
234
236
250
262
252
244
204
258
270
266
264
256
268
208
206
260
246
248
254
242

DOCUMENT SHREDDING MACHINE

BACKGROUND OF THE INVENTION

This invention relates to a compact, easy to assemble, low cost paper shredder.

In order to destroy documents to preserve their confidentiality, commercial shredders exist which cut the paper into narrow strips. Typically, the cutting is achieved by a series of circular cutters which are arranged along the axis of two rotating members. The cutters of one rotating member are offset so that the cutters pass between the cutters of the other member.

The actual structure of the rotating members having cutters can be a solid bar of steel or similar material in which cutters and spacers are formed by machining so that the cutters and spacers are all integral to one another. Another structure has separate cylindrical members of a large diameter which are used as the cutters and are spaced apart by separate cylindrical spacers which are assembled on a shaft in an alternating relationship.

The problem with these shredding devices is that the shaft must be mounted on bearing plates within the housing. This requires assembly of a number of parts and fasteners. The present invention solves these problems by providing molded bearing plates integral to the inside surfaces of the housing. Therefore, no parts or assembly is required to mount the shafts.

Another problem with known and existing shredding devices is that after the paper has been cut into strips, the strips tend to wind around the cutters and spacers, clogging the cutting area. To solve this problem it has been suggested to provide a stripping means to strip away the cut paper. Typically, the stripping means consist of a serrated member or a comb type member having teeth which protrude in the spaces between the individual cutters. These members are located on the outward or post-shredder side of the cutting area.

For example, U.S. Pat. No. 4,068,805 shows a comb means rigidly placed at the exit of the cutters and extending into at least one of the cutters.

Another method of providing a stripping means is shown in U.S. Pat. No. 3,033,064 which discloses a pair of combs each having a series of spaced teeth that project into the spaces between the cutters to remove the cut strips of paper. Each comb is rigidly mounted so that the teeth protrude into the side of the cutter shaft opposite of the cutting area. In addition, they are formed in a semi-circular shape so that they wrap around the series of cutters.

In addition, it has been suggested to provide a comb type member before the cutters. The comb then guides the uncut paper into the cutters. U.S. Pat. No. 4,018,392 shows a pair of combers attached to support rods, each comber having a tongue protruding forward of the cutters to comb and direct the material being fed to the cutting surfaces of the cutters.

The problem with these shredders and others is that a number of individual parts are required. Separate parts are required for the comb assembly and for mounting to the shredder housing. This increases the time and labor required to assemble the shredder which in turn increases the cost of the shredder. Therefore, the present invention is directed to a paper shredder that has few parts and is easy to assemble. This will result in a paper shredder that has a lower cost than conventional paper shredders.

SUMMARY OF THE INVENTION

The invention provides a continuous stripper for removing cut material from the cutting area of a paper shredder. The stripper extends from the inside surface of the top housing through the cutting area to the inside surface of the bottom base. The stripper consists of upper teeth integrally formed on the inside surface of the top housing. The upper teeth substantially abut lower teeth integrally formed on the inside surface of the bottom base to form the continuous stripper. The continuous stripper thus prevents the cut material from winding around the cutting mechanism and clogging the shredder.

The invention further provides a paper shredder having a molded top housing with a feed opening and a molded base with a discharge opening. When joined, they form the outside structure of the paper shredder.

Both the top housing and the base have teeth that are integrally formed to their inside surfaces. The teeth on the top housing have a female end at their tip, whereas the teeth on the base have a male end at their tip. When the top housing and the base are joined, the teeth substantially abut to form a continuous stripper. The stripper extends from the top housing through the spaces formed by the spacers and to the bottom of the base.

This arrangement provides a stripper both before and after the cutter surface. The stripper can guide the paper into the cutting surface and prevent the cut paper strips from clogging the cutting area. Furthermore, because the teeth are molded as part of the housing and the base, no mounting parts or assembly labor is required for the stripper. This results in a shredder having a cost less than that of a conventional paper shredder.

In addition, there are provided a pair of top debris plates and a pair of bottom debris plates. The top debris plates are located inside the top housing opposite each other and extend laterally at the sides of the feed opening. In a similar fashion, bottom debris plates are located inside the bottom housing opposite each other and extend laterally at the sides of the discharge opening. Each plate has a pair of semicircular indentations so that when the top housing is joined to the bottom housing the top debris plates and the bottom debris plates will prevent stripped material from entering the shredder, yet allow the shafts of cutting cylinders to pass through.

The invention also provides a bearing support integrally formed on the bottom base to rotatably carry the shafts of cutting cylinders provided in the shredder. The bearing support consists of two bearing plates formed on the inside surface of the bottom base and located opposite each other. Each bearing plate has two semicircular indentations formed into the bearing plate to carry the shafts.

The top housing has bearing plates opposite each other and integrally molded on the inside surface. The bearing plates have two semicircular indentations formed in the plate. The indentations cooperate with the respective semicircular indentations provided in the bearing plates located on the inside surface of the base.

Two cutting cylinders are mounted parallel to each other so that they interleave to form a nip. The cutting cylinders have cutter portions alternately spaced on a central shaft. Preferably, the cutting portions are cutter discs alternately spaced by spacers. When the shafts are rotated in opposite directions, the cylinders draw paper into the nip and cut or shred it into thin strips. The shafts are rotatably supported by the semicircular indentations located on the bearing plates of the base. When the top housing is joined to the base, the shafts are substantially enclosed by the cooperating indentations.

In this way, metal bearing plates, distance shafts, and fasteners which are normally used, can be omitted. The result is that the assembly is simplified. Furthermore, such a design results in a paper shredder that has a low cost.

Alternatively, the bearing plates are a separate formed structure. In this case, a pair of bearing plates are located opposite each other. The bearing plates are formed such that they are held in place when the top housing is joined to the bottom base.

In another embodiment, the debris plates rotatably carry the shafts of the cutting cylinders. Thus, separate bearing plates are not required. In this case, when the top housing is joined to the bottom base, the semicircular indentations of the top debris plate and the bottom debris plate cooperate to support and substantially enclose the shafts of the cutting cylinders.

DETAILED DESCRIPTION OF THE INVENTION AND PREFERRED EMBODIMENTS

Figure 1:
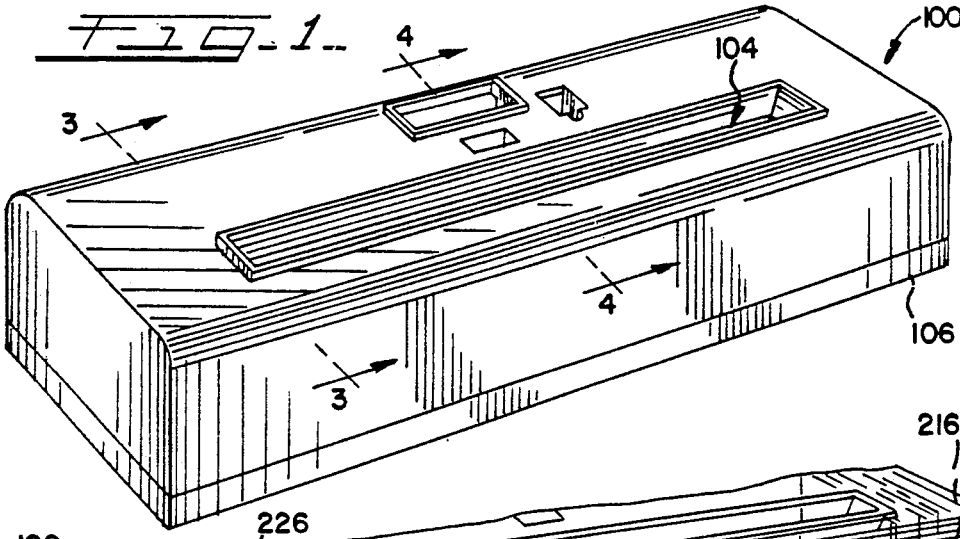
FIG. 1 is a surface view of an assembled paper shredder with the top housing partially cut-away.

FIG. 1 illustrates a paper shredding machine having top housing 100 and bottom base 106. Paper is fed into feed opening 104 located on the top surface of top housing 100. The paper is shredded by cutting cylinders 230, shown in FIG. 2, and is ejected from discharge opening 400, shown in FIG. 4, located on bottom base 106.

Figure 2:
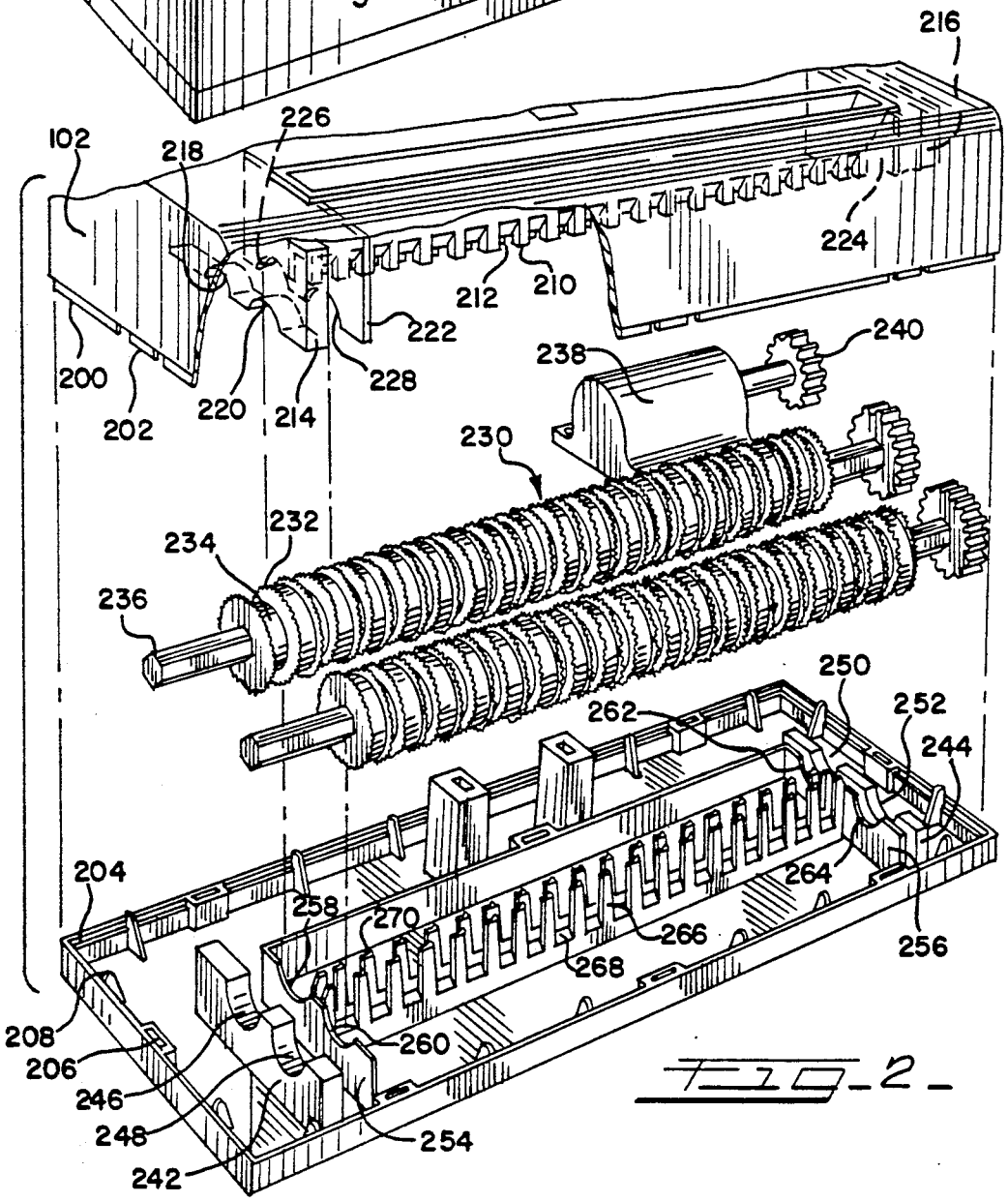
FIG. 2 is an exploded view of an assembled paper shredder.

FIG. 2 shows top housing 100 with sides 102 that are recessed at the bottom to provide top shoulder 200. Top shoulder 200 has fingers 202 extending downward. Base 106 also has a recessed edge to provide base shoulder 204 which will positively couple with top shoulder 200 provided in top housing 100 when top housing 100 is joined to base 106. Base shoulder 204 is interrupted by slits 206 which will engage fingers 202 to further provide a secure fit between top housing 100 and bottom base 106.

Furthermore, base 106 has protrusions 208 located on the inside bottom of the base and contacting base shoulder 204. Protrusions 208 extend upward to guide and to contact top shoulder 200 of top housing 100 to further provide a secure fit when top housing 100 and base 106 are joined.

Figure 3:
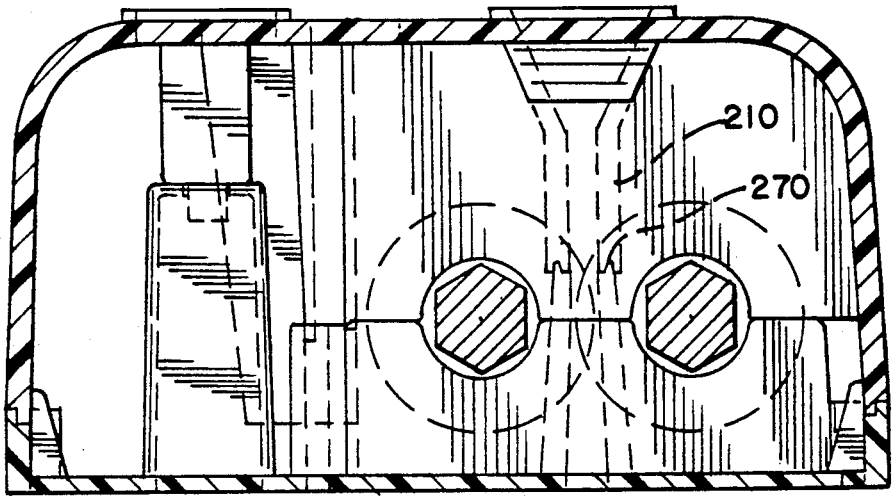
FIG. 3 is a cross section of the paper shredder taken along line 3—3 of FIG. 1.
Figure 4:
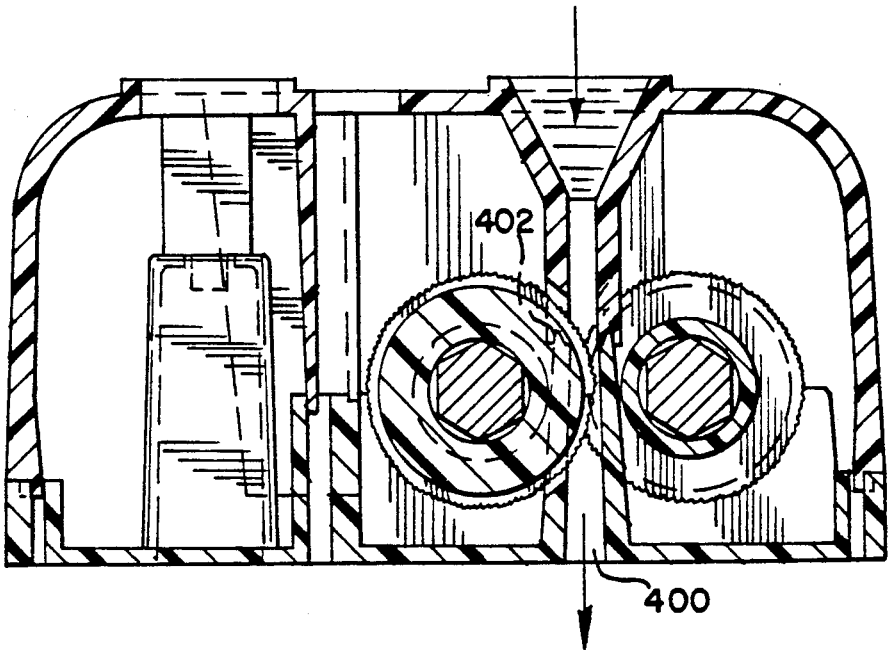
FIG. 4 is a cross section of the paper shredder taken along line 4—4 of FIG. 1.

Top housing 100 has feed opening 104 located on the top surface of top housing 100. Feed opening 104 is sized to allow several sheets of paper to be fed into it. In addition, feed opening 104 is tapered downward on opposite sides to assist the travel of the paper downward to and through cutting cylinders 230. The ends of the tapered portion are formed into a series of upper teeth 210 that extend downward as better seen in FIG. 3. Upper teeth 210 are spaced apart at regular intervals to provide space 212 between each tooth. Also, upper teeth 210 on one side extend down while on the opposite side there is space 212 between the teeth. Thus, upper teeth 210 on both sides extend downward in an alternating fashion to form one-half of a stripper means. As shown in FIG. 4, teeth 210 have a female end 402 at the distal end provided for mating purposes.

The inside surface of top housing 100 has at opposite ends top debris plate 222, 224 of any suitable width. At the first end, top debris plate 222 has semicircular indentations 226 and 228. At the second end, top debris plate 224 has similar semicircular indentations.

The inside surface of bottom base 106 has at opposite ends bottom debris plate 254, 256 of any suitable width. At the first end, bottom debris plate 254 has semicircular indentations 258 and 260. At the second end, bottom debris plate 256 has semicircular indentations 262, 264. When top housing 100 is joined to bottom base 106, top debris plate 222, 224 and bottom debris plate 254, 256 substantially cooperate such that shafts 236 of cutting cylinder 230 are surrounded.

In a first embodiment, the inside surface of top housing 100 has on opposite ends top bearing plate 214, 216 molded to the inside surface of top housing 100. At the first end, bearing plate 214 has semicircular indentations 218, 220. At the second end, bearing plate 216 has similar semicircular indentations. The inside surface of base 106, as shown in FIG. 2, has at opposite ends bottom bearing plate 242, 244 molded to the inside surface of base 106. On each bottom half bearing plate 242, 244 there are semicircular indentations 246, 248, 250, 252 provided to carry the load of cutting cylinders 230.

Figure 5:
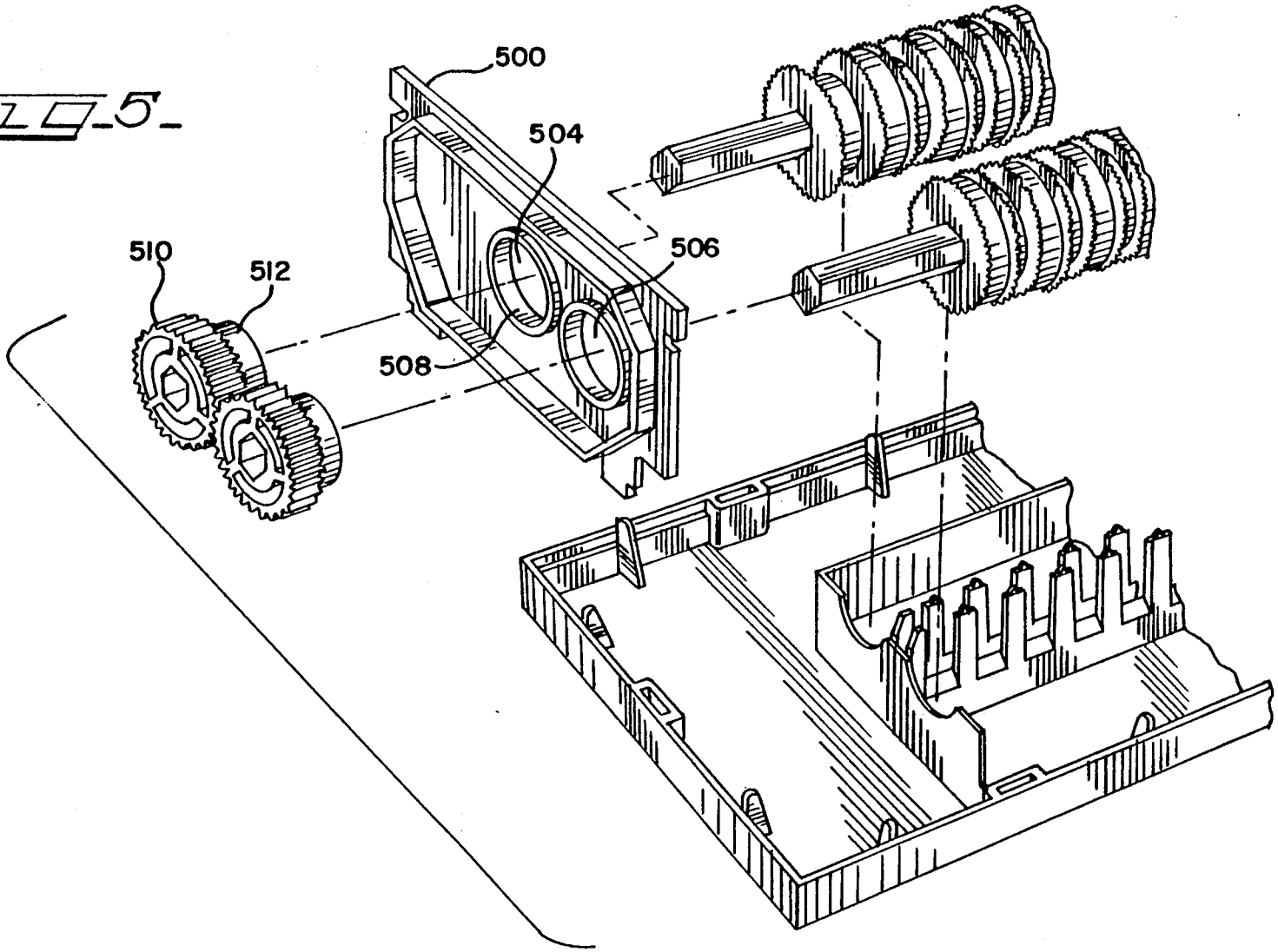
FIG. 5 is an exploded view of a portion of the bottom base with a separate molded bearing support.

In a second embodiment, shown in FIG. 5, there is located on one end of bottom housing 106 bearing support plate 500 and a similar bearing support plate on the opposite end. As shown in FIG. 5, there is provided holes 504, 506 in bearing plate 500, so that the shafts 236 can pass through. There are similar holes in the opposite bearing plate. Each hole 504, 506 and the holes on the opposite bearing support have shoulder 508. Gears 510 are fixably attached to each end of shafts 236 so that gears 510 are cooperatively meshed. Gears 510 are provided with shoulder 512 to rotatably engage with shoulder 508 on holes 504, 506 in bearing plate 500 and the similar respective holes in the opposite bearing plate. Bearing plate 500 is formed such that when top housing 100 is joined to bottom base 106 bearing plate 500 is securely supported.

In a third embodiment, the bearing plate may also serve as the debris plate. In this case, the bottom debris plate 254, 256 would be of suitable width to rotatably support shafts 236 of the cutting cylinders 230.

As shown in FIG. 4, the inside surface of base 106 has a discharge opening 400 to allow the cut strips of paper to fall through. In addition, there are a series of lower teeth 266, better seen in FIG. 2, that extend upward and are formed on opposite sides of the inside portion of discharge opening 400. Lower teeth 266 are spaced apart at regular intervals to provide space 268 between each tooth. Also, lower teeth 266 on one side extend upward while on the opposite side there is space 268 between the teeth. Thus, lower teeth 266 on both sides extend upward in an alternating fashion to form one-half of a stripper means.

As shown in FIG. 4, lower teeth 266 have a male end 270 at the distal end which will mate with female end 402 in upper teeth 210 when top housing 100 is joined with base 106. When top housing 100 is joined with base 106, upper teeth 210 and lower teeth 266 form a completed stripper means that extends downward from feed opening 104 through cutting cylinders 230 to discharge opening 400.

Cutting cylinders 230 are arranged in parallel and interleave to form a nip. Each cutting cylinder 230 contains cutter discs 232 alternately spaced by spacers 234 and mounted on central shaft 236.

An appropriate gear 240 driven by reversible motor 238 is coupled to shafts 236 to drive cutting cylinders 230 in opposite directions. This action will allow cutter discs 232 to grasp and pull the paper into and through the cutting area so that the paper is cut into thin strips. It will be appreciated that a suitable switch can be used to actuate the motor so that the gear can turn in either a forward or a reverse direction. Alternatively, an electric eye can be provided in feed opening 104 to automatically activate motor 238.

The interaction between cutting cylinders 230 and upper teeth 210 and lower teeth 266 can be seen in FIG. 4. Lower teeth 266 alternately extend upward in the spaces between cutter discs 232 provided by spacers 234. Simultaneously, upper teeth 210 alternately extend downward in the spaces between cutter discs 232 provided by spacers 234. Thus, when top housing 100 and base 106 are joined, teeth 210 and 266 mate to form continuous strippers which are located in the void created by spacers 234. The strippers guide the paper to the cutting area and strip debris from the cutting area keeping it clean and free from jamming.

Of course, it should be understood that a wide range of changes and modifications can be made to the preferred embodiment described above. It is therefore intended that the foregoing description illustrates rather than limits this invention, and that it is the following claims, including all equivalents, which define this invention.

We claim:

1. In combination with a shredding machine having a top housing, a cutting mechanism defining a cutting area, and a bottom base, a continuous stripper for the cutting area of a shredding machine comprising:

a) upper teeth integrally formed onto the top housing; and, b) lower teeth integrally formed onto the bottom base such that when the top housing is joined to the bottom base the upper teeth substantially abut the lower teeth to form a continuous stripper that extends from the top housing through the cutting area and to the bottom base.

2. The stripper of claim 1 where the upper teeth have a female end at the distal end and the lower teeth have a male end at the distal end.

3. The stripper of claim 1 where the top housing, the bottom base, the upper teeth, and the lower teeth are molded from plastic.

4. A shredding machine comprising:

a) a top housing with four sides extending downward and having a feed opening formed on the top surface, the feed opening having a first long side extending downward, a second long side extending downward opposite the first long side, a first short side extending downward, and a second short side extending downward opposite the first short side, the short sides being perpendicular to the long sides;

b) a first row of upper teeth formed at the lower end of the first long side of the feed opening, the teeth spatially arranged and extending downward;

c) a second row of upper teeth formed at the lower end of the second long side of the feed opening, the teeth spatially arranged and extending downward such that the second row of teeth are staggered with respect to the first row of teeth;

d) a first top debris plate abutting the first short side of the feed opening and extending downward and laterally beyond both long sides of the feed opening;

e) a second top debris plate abutting the second short side of the feed opening and extending downward and laterally beyond both long sides of the feed opening;

f) a base with four sides extending upward and having a discharge opening formed on the bottom surface, the discharge opening having a first long side extending upward, a second long side extending upward opposite the first long side, a first short side extending upward, and a second short side extending upward opposite the first short side, the short sides being perpendicular to the long sides;

g) means for bearing a shaft;

h) a first row of lower teeth formed at the upper end of the first long side of the discharge opening, the teeth spatially arranged and extending upward;

i) a second row of lower teeth formed at the upper end of the second long side of the discharge opening, the teeth spatially arranged and extending upward such that the second row of teeth are staggered with respect to the first row of teeth;

j) a first bottom debris plate abutting the first short side of the discharge opening and extending upward and laterally beyond both long sides of the discharge opening;

k) a second bottom debris plate abutting the second short side of the discharge opening and extending upward and laterally beyond both long sides of the discharge opening;

l) a first cutting cylinder mounted on a central shaft, the shaft rotatably mounted on the shaft bearing means so that the cutting portions of the cylinder extend into the spaces provided on the first row of lower teeth;

m) a second cutting cylinder parallel to the first cutting cylinder and mounted on a central shaft, the shaft rotatably mounted on the shaft bearing means so that the cutting portions of the cylinder extend into the spaces provided on the second row of lower teeth, the cutting portions of the second cylinder being interleaved with the cutting portions of the first cylinder to form a nip; and n) means for driving the shafts counter to each other.

5. The shredding machine of claim 4 wherein:

a) the top debris plates have a first substantially semicircular indentation formed onto the top debris plate and located on a first side of the feed opening, a second substantially semicircular indentation formed onto the top debris plate and located on a second side of the feed opening; and b) the bottom debris plates have a first substantially semicircular indentation formed onto the bottom debris plate and located on a first side of the discharge opening, a second substantially semicircular indentation formed onto the bottom debris plate and located on a second side of the discharge opening such that when the top housing and the bottom base are joined the shafts can pass through.

6. The shredding machine of claim 4 where the upper teeth have a female end at the distal end, and the lower teeth have a male end at the distal end.

7. The shredding machine of claim 4 wherein the means for bearing a shaft comprises:

a) a first bearing plate at the first short side of the opening and extending upwardly and laterally beyond both long sides of the discharge opening;

b) a first substantially semicircular indentation formed onto the first bearing plate and located on one side of the discharge opening;

c) a second substantially semicircular indentation formed onto the first bearing plate and located on the other side of the discharge opening;

d) a second bearing plate at the second short side of the opening and extending upwardly and laterally beyond both long sides of the discharge opening;

e) a first substantially semicircular indentation formed onto the second bearing plate and located on one side of the discharge opening; and f) a second substantially semicircular indentation formed onto the second bearing plate and located on the other side of the discharge opening, so that the shaft of the first cutting cylinder is rotatably carried by the first semicircular indentation on the first bearing plate and the first semicircular indentation on the second bearing plate and so that the shaft of the second cutting cylinder is rotatably carried by the second semicircular indentation on the first bearing plate and the second semicircular indentation on the second bearing plate.

8. The shredding machine of claim 4 wherein the means for bearing a shaft comprises:

a) a first bearing support plate at the first short side of the discharge opening extending upwardly and laterally beyond both long sides of the discharge opening;

b) a first hole formed in the first support and located on a first side of the discharge opening;

c) a second hold formed in the first support and located on a second side of the discharge opening;

d) a second bearing support plate at the second short side of the discharge opening extending upwardly and laterally beyond both long sides of the discharge opening;

e) a first hole formed in the second support and located on a first side of the discharge opening; and f) a second hole formed in the second support and located on a second side of the discharge opening such that the shaft for the first cutting cylinder is rotatably secured by the first hole in the first bearing plate and the first hole in the second bearing plate, and the shaft for the second cutting cylinder is rotatably secured by the second hole in the first bearing plate and the second hole in the second bearing plate.

9. The shredding machine of claim 8 wherein the bearing supports are secured in place when the top housing is joined to the bottom base.

10. The shredding machine of claim 8 wherein the bearing supports are formed from plastic.

11. The shredding machine of claim 4 wherein at least one of the cutting cylinders contain cutter discs mounted on its central shaft.

12. The shredding machine of claim 4 wherein the first cutting cylinder contains cutter discs mounted on its central shaft.

13. The shredding machine of claim 4 wherein the second cutting cylinder contains cutter discs mounted on its central shaft.

14. The shredding machine of claim 4 wherein both cutting cylinders contain cutter discs mounted on their respective central shaft.

15. A shredding machine comprising:

a) a top housing with four sides extending downward and having a feed opening formed on the top surface, the feed opening having a first long side extending downward, a second long side extending downward opposite the first long side, a first short side extending downward, and a second short side extending downward opposite the first short side, the short sides being perpendicular to the long sides;

b) a first row of upper teeth formed at the lower end of the first long side of the feed opening, the teeth spatially arranged and extending downward;

c) a second row of upper teeth formed at the lower end of the second long side of the feed opening, the teeth spatially arranged and extending downward such that the second row of teeth are staggered with respect to the first row of teeth;

d) a base with four sides extending upward and having a discharge opening formed on the bottom surface, the discharge opening having a first long side extending upward, a second long side extending upward opposite the first long side, a first short side extending upward, and a second short side extending upward opposite the first short side, the short sides being perpendicular to the long sides;

e) means for bearing a shaft;

f) a first row of lower teeth formed at the upper end of the first long side of the discharge opening, the teeth spatially arranged and extending upward;

g) a second row of lower teeth formed at the upper end of the second long side of the discharge opening, the teeth spatially arranged and extending upward such that the second row of teeth are staggered with respect to the first row of teeth;

h) a first cutting cylinder mounted on a central shaft, the shaft rotatably mounted on the shaft bearing means so that the cutting portions of the cylinder extend into the spaces provided on the first row of lower teeth;

i) a second cutting cylinder parallel to the first cutting cylinder and mounted on a central shaft, the shaft rotatably mounted on the shaft bearing means so that the cutting portions of the cylinder extend into the spaces provided on the second row of lower teeth, the cutting portions of the second cylinder being interleaved with the cutting portions of the first cylinder to form a nip; and j) means for driving the shafts counter to each other.

16. The shredding machine of claim 15 wherein the means for bearing a shaft comprises:

a) a first bearing plate abutting the first short side of the discharge opening and extending upwardly and laterally beyond both long sides of the discharge opening;

b) a first substantially semicircular indentation formed onto the first bearing plate and located on one side of the discharge opening;

c) a second substantially semicircular indentation formed onto the first bearing plate and located on the other side of the discharge opening;

d) a second bearing plate abutting the second short side of the discharge opening and extending upwardly and laterally beyond both long sides of the discharge opening;

e) a first substantially semicircular indentation formed onto the second bearing plate and located on one side of the discharge opening; and, f) a second substantially semicircular indentation formed onto the second bearing plate and located on the other side of the discharge opening so that the shaft of the first cutting cylinder is rotatably carried by the first semicircular indentation on the first bearing plate and the first semicircular indentation on the second bearing plate and so that the shaft of the second cutting cylinder is rotatably carried by the second semicircular indentation on the first bearing plate and the second semicircular indentation on the second bearing plate.

17. The shredding machine of claim 15 wherein at least one of the cutting cylinders contain cutter discs mounted on its central shaft.

18. The shredding machine of claim 15 wherein the first cutting cylinder contains cutter discs mounted on its central shaft.

19. The shredding machine of claim 15 wherein the second cutting cylinder contains cutter discs mounted on its central shaft.

20. The shredding machine of claim 15 wherein both cutting cylinders contain cutter discs mounted on their respective central shaft.

* * * * *

UNITED STATES PATENT AND TRADEMARK OFFICE

CERTIFICATE OF CORRECTION

PATENT NO. : 5,071,080

DATED : December 10, 1991

INVENTOR(S) : David E. Herbst et al.

It is certified that error appears in the above-identified patent and that said Letters Patent is hereby corrected as shown below:

On the title page, column 2, after "Attorney, Agent, or Firm" please delete "Willian, Brinks, Olds, Hofer, Gilson & Lione" and substitute therefor --Willian Brinks Olds Hofer Gilson & Lione--.

Signed and Sealed this

Seventh Day of September, 1993

Bruce Lehman

*Attest:*

BRUCE LEHMAN

*Attesting Officer*

*Commissioner of Patents and Trademarks*